US005850803A

United States Patent [19]

Jones et al.

[11] Patent Number: 5,850,803

[45] Date of Patent: Dec. 22, 1998

[54] PERSONAL WATERCRAFT HAVING DAYTIME RUNNING HEADLIGHT

[75] Inventors: Corbett B. Jones, Mequon; Edwin B. Hatch, West Bend; Steven J. Gonring, Slinger; David D. Jones, Mequon; Joseph H. Pomeroy, Fond du Lac, all of Wis.

[73] Assignee: Brunswick Corporation, Lake Forest, Ill.

[21] Appl. No.: 861,290

[22] Filed: May 21, 1997

[51] Int. Cl.[6] ..... B63B 8/00

[52] U.S. Cl. ..... 114/343; 362/61; 114/270

[58] Field of Search ..... 114/343, 270, 114/364; 440/38; 362/72, 61

[56] References Cited

U.S. PATENT DOCUMENTS

| | | | |
|---|---|---|---|
| 3,939,339 | 2/1976 | Alphen | 362/72 |
| 4,694,770 | 9/1987 | Kitner et al. | 114/123 |
| 5,276,593 | 1/1994 | Lighthill et al. | 362/72 |
| 5,353,730 | 10/1994 | Talbot | 114/248 |

FOREIGN PATENT DOCUMENTS

| | | | |
|---|---|---|---|
| 244689 | 10/1986 | Japan | 114/343 |
| 257390 | 11/1986 | Japan | 114/343 |
| 257391 | 11/1986 | Japan | 114/270 |

OTHER PUBLICATIONS

Enhancing the Conspicuity of Personal Watercraft, Marine Technology Society, Milligan et al., pp. 1–11, Sep., 1996.

*Primary Examiner*—Stephen Avila
*Attorney, Agent, or Firm*—Andrus, Sceales, Starke & Sawall

[57] ABSTRACT

A personal watercraft has a daytime running headlight that illuminates continuously or stroboscopically when the personal watercraft is operating. The daytime running headlight makes the watercraft more noticeable to other boaters. Several embodiments are shown in which one or more daytime running headlights are mounted to the personal watercraft above the deckline of the watercraft and forward of the handlebars of the watercraft. Such positioning renders the daytime running headlight easily noticeable to other boaters even in relatively choppy water. The daytime running headlights should not only illuminate light forward of the watercraft, but should also illuminate peripherally from the watercraft. A linkage mechanism can be used to turn the one or more headlights in the direction in which the watercraft is turning.

17 Claims, 6 Drawing Sheets

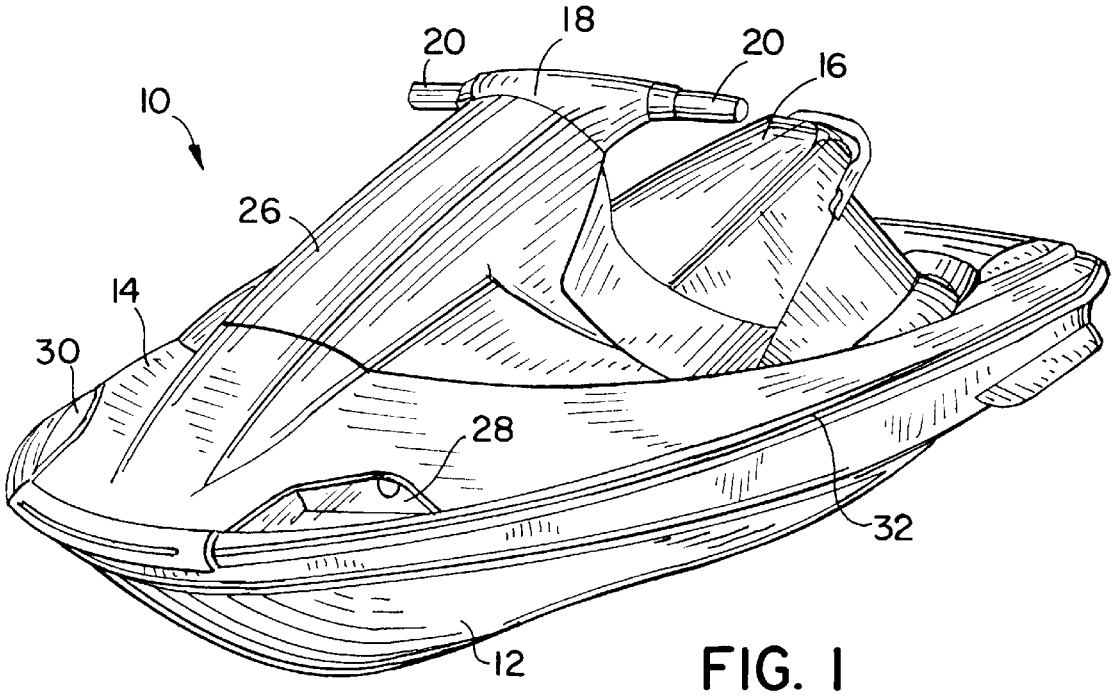
FIG. 1
FIG. 2
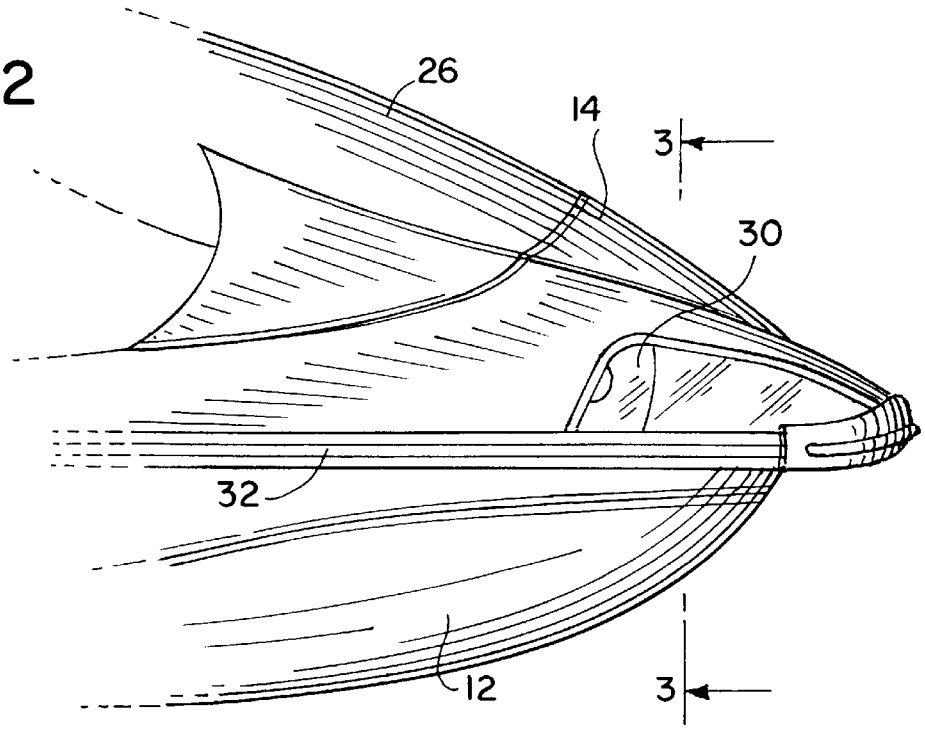

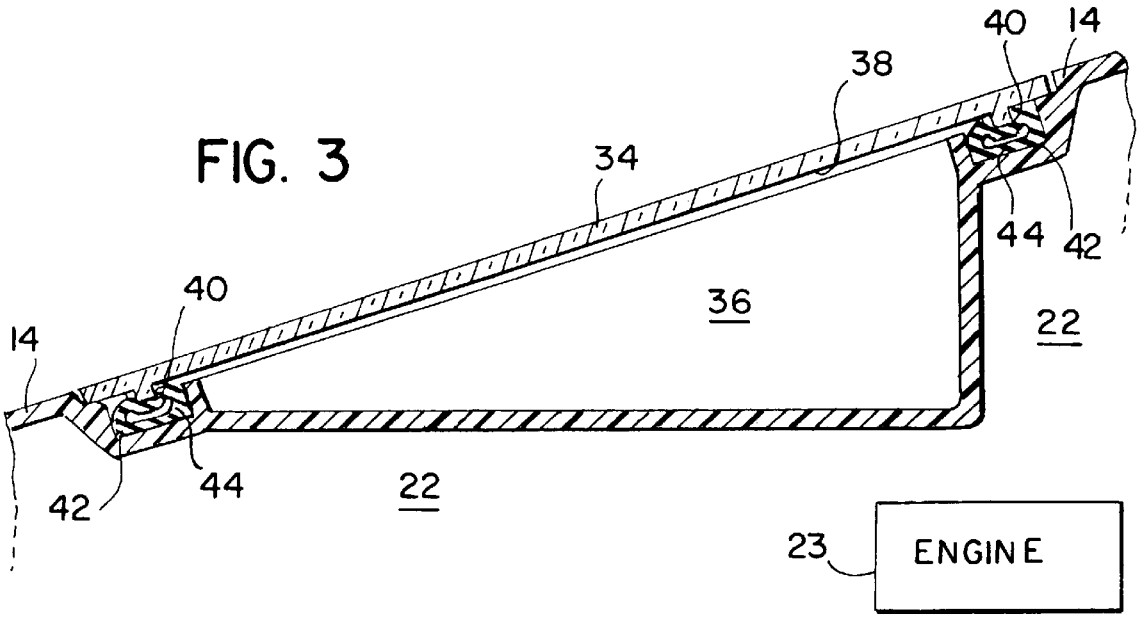
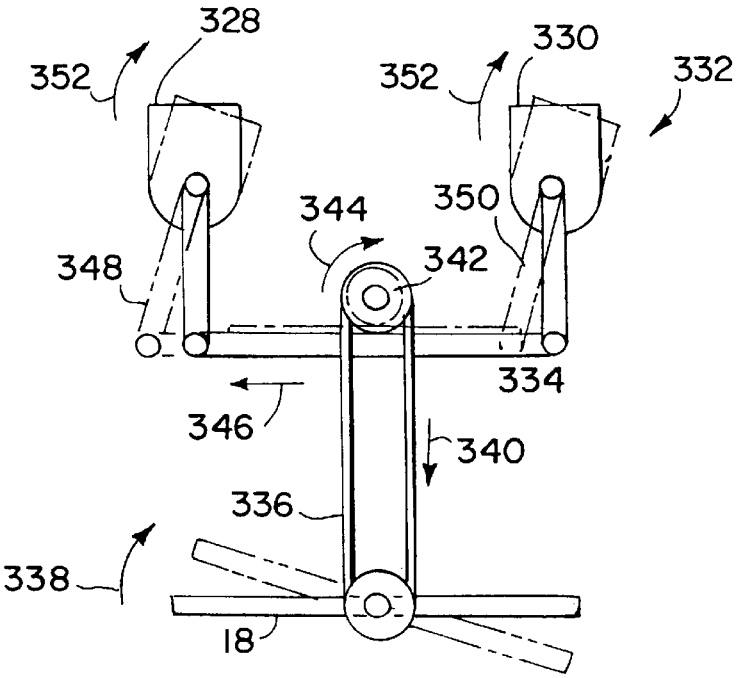
FIG. 10

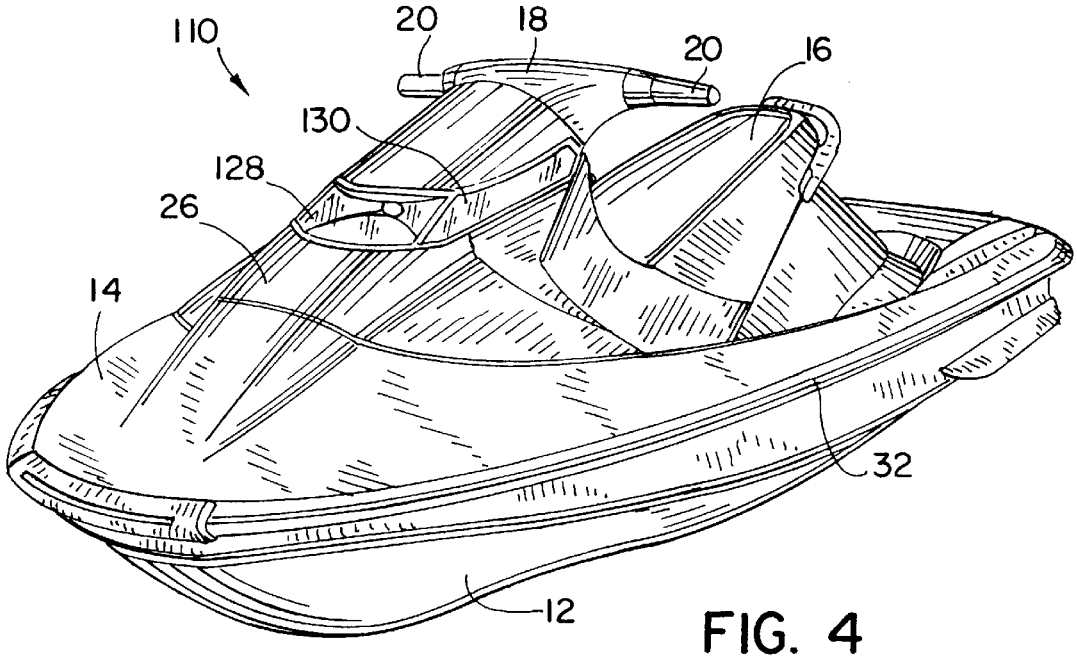
FIG. 4
FIG. 5
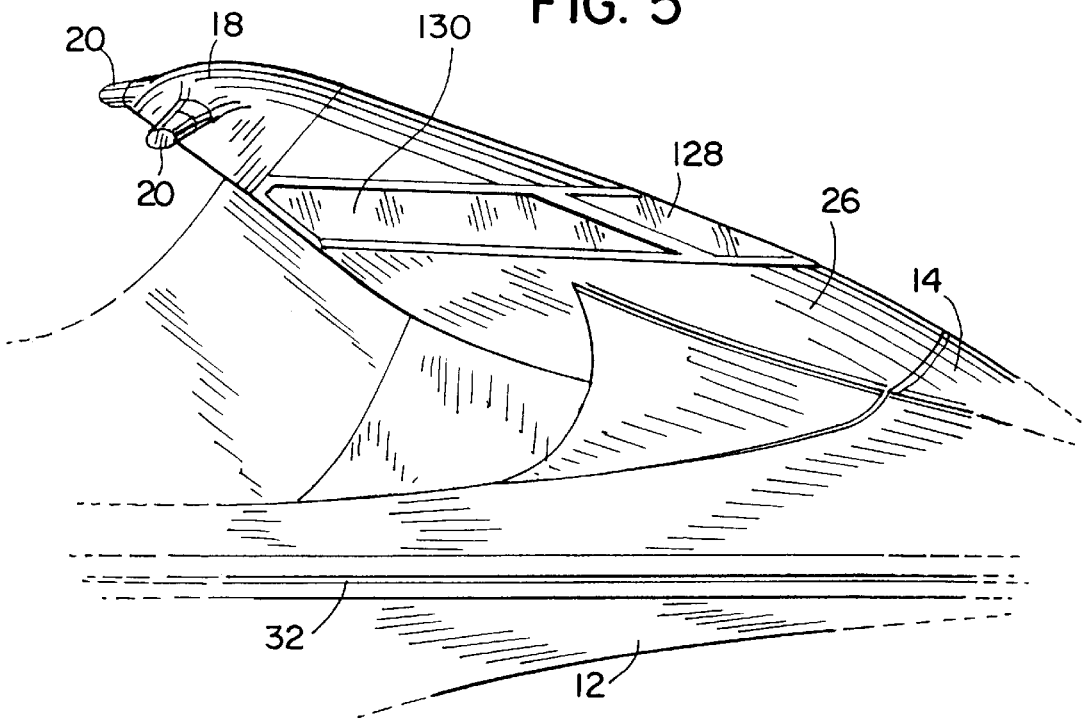

PERSONAL WATERCRAFT HAVING DAYTIME RUNNING HEADLIGHT

FIELD OF THE INVENTION

The invention relates to personal watercraft and in particular to the use of a daytime running headlight that is illuminated whenever the personal watercraft is operating.

BACKGROUND OF THE INVENTION

Personal watercraft are small compared to other powered recreational boats. In general, personal watercraft have quick acceleration and exceptional maneuverability when under power. A driver and/or passenger riding a personal watercraft normally straddles the seat located rearward of a steering assembly. The driver of the watercraft uses the steering assembly to steer the watercraft. Personal watercraft can achieve relatively high speeds on water (for example, speeds exceeding 45 mph).

Under some circumstances, it may be difficult for other boaters to notice personal watercraft cruising in their vicinity. The potential for collisions involving personal watercraft may be exacerbated due to the relatively small size of personal watercraft, and the exceptional acceleration and maneuverability of personal watercraft. However, the possibility of collisions may be diminished if other boaters are more likely to notice personal watercraft cruising in their vicinity.

BRIEF SUMMARY OF THE INVENTION

The invention is a daytime running headlight for a personal watercraft that illuminates when the personal watercraft is operating, thereby making the watercraft more noticeable to other boaters.

In personal watercraft, a deck shell is attached to a hull shell along a deckline. A steering assembly having a handlebar is mounted to the deck shell forward of the seat. The daytime running headlight should be mounted to the watercraft above the deckline and forward of the handlebar so that light illuminating from the daytime running headlight is easily visible to other boaters even in relatively choppy water.

A personal watercraft in accordance with the invention can contain one or two (or possibly even more) daytime running headlights. It is preferred that light illuminating from the one or more daytime running headlights be visible not only forward of the watercraft but also peripherally from the watercraft. For instance, light illuminated from the one or more headlights should be noticeable to a boater approaching the personal watercraft at a 90° angle.

Another feature of the invention that improves conspicuity to other boaters is to provide stroboscopic light from the one or more daytime running headlights. Providing stroboscopic light has the additional advantage of reducing electrical power requirements for the one or more headlights. This is important because by nature personal watercraft do not normally have substantial excess electrical power capacity. Several embodiments of the invention turn the one or more daytime running headlights in the direction the personal watercraft is turned.

Other features and objects of the invention may be apparent to those skilled in the art upon reviewing the following drawings and description thereof.

BRIEF DESCRIPTION OF THE DRAWINGS

FIG. 1 is a perspective view of a personal watercraft having a daytime running headlight in accordance with a first embodiment of the invention.

FIG. 2 is a side elevational view of the bow of the personal watercraft shown in FIG. 1.

FIG. 3 is a sectional view of a sealed headlight compartment taken along line 3—3 in FIG. 2.

FIG. 4 is a perspective view of a personal watercraft having a daytime running headlight in accordance with a second embodiment of the invention.

FIG. 5 is a side elevational view of the bow portion of the personal watercraft shown in FIG. 4.

FIG. 10 is a schematic drawing illustrating a linkage for directing the daytime running headlight in accordance with the position of the steering assembly.

DETAILED DESCRIPTION OF THE INVENTION

Figure 6:
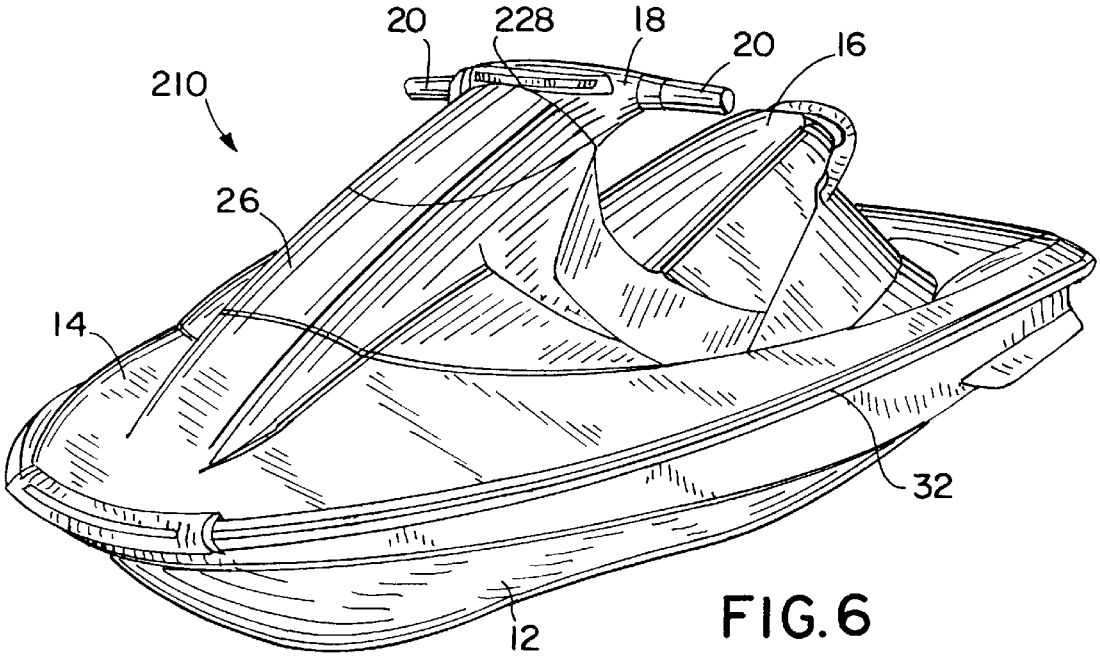
FIG. 6 is a perspective view of a personal watercraft having a daytime running headlight in accordance with a third embodiment of the invention.

FIG. 1 illustrates a personal watercraft 10 in accordance with a first embodiment of the invention. The watercraft 10 has a hull 12 and a deck 14, both preferably made of fiber-reinforced plastic. A driver and/or passenger riding the watercraft 10 is positioned on the seat 16. The driver steers the watercraft 10 using a steering assembly 18 which includes an operator-grippable steering member provided by handlebars 20 located forward of the seat 16. The steering assembly 18 moves the orientation of a tubular rudder (not shown) for a jet pump to steer the watercraft 10. The seat 16 is generally longitudinal and configured so that a driver and/or passenger on the watercraft 10 straddles the seat 16 while riding the watercraft 10.

Figure 11:
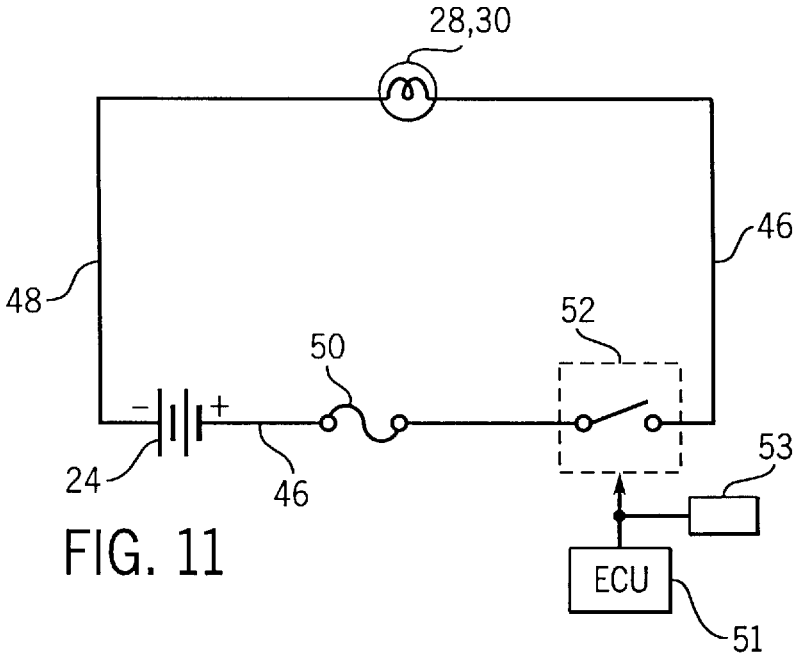
FIG. 11 is a schematic drawing showing an electrical circuit for providing power to a daytime running headlight in accordance with the invention.
Figure 12:
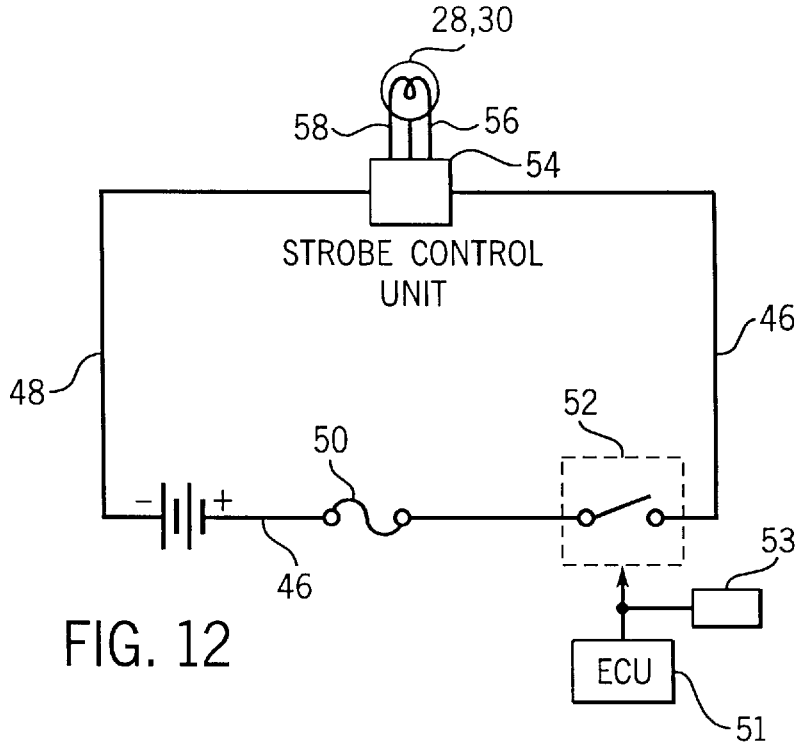
FIG. 12 is a schematic drawing illustrating an electrical circuit for providing strobe power to a daytime running headlight in accordance with the invention.

The hull 12 and the deck 14 are generally shell-like components that are combined to form a hollow engine compartment 22, FIG. 3, that is located within the space between the hull 12 and the deck 14. The deck shell 14 interfaces the hull shell 12 along a deckline 32. An internal combustion engine, schematically shown at 23, is located within the engine compartment 22. A 12-volt DC battery 24, FIGS. 11 and 12, is also located within the engine compartment 22. The engine compartment 22 is accessible forward of the steering assembly 18 by opening a hood assembly 26.

In accordance with the invention, the watercraft 10 includes a port side daytime running headlight 28 and a starboard side daytime running headlight 30. Both the port side daytime running headlight 28 and the starboard side daytime running headlight 30 are mounted to the watercraft 10 above the deckline 32 and forward of the handlebar 20 of the steering assembly 18.

Mounting the daytime running headlights 28, 30 to the deck shell 14 is desirable because it is relatively easy to run wiring from inside the engine compartment to the daytime running headlights 28, 30.

The daytime running headlights 28, 30 are positioned on the watercraft 10 to improve the noticeability of the watercraft 10 to other boaters, especially when the watercraft 10 is moving straight forward and/or steered to turn in the forward direction. The daytime running headlights 28, 30 are preferably conventional automotive 55W low-beam, white headlights. It is preferred that the daytime running headlights 28, 30 have a center illumination axis that is directed approximately straight forward of the watercraft 10. The headlights 28, 30 should illuminate light that is visible not only in the straight forward direction, but also peripherally at least 90° rearward of the headlight illumination axes. The daytime running headlight system shown in FIG. 1 is particularly effective at providing peripheral illumination inasmuch as the port side daytime running headlight 28 and the starboard side daytime running headlight 30 are easily visible from the side of the watercraft 10 (see FIG. 2).

It is important to protect the headlights 28, 30, as well as the associated electrical circuitry, from the effects of water (e.g. thermal shock, corrosion, etc.). In order to use conventional automotive headlights, it is therefore desirable to locate the headlights 28, 30 behind a sealed transparent lens cover 34. The lens cover 34 is preferably clear so that white light is illuminated. Alternatively, a tinted lens cover 34 may be used to illuminate non-white light, such as amber. Referring to FIG. 3, the transparent lens cover 34 covers a headlight compartment 36 that is molded into the deck shell 14 of the watercraft 10. The lens cover 34 includes an inside surface 38 that has an endless sealing ridge 40 extending perpendicularly downward from the lens cover 34 near the outer edge of the lens cover 34. When the lens cover 34 is secured in place, the sealing ridge 40 compresses a resilient sealing strip 42 that is located in a channel 44 surrounding the headlight compartment 36. The compression of the sealing ridge 40 on the lens cover 34 against the resilient sealing strip 42 provides a watertight seal completely around the headlight compartment 36. Thus, headlights 28, 30, as well as associated circuitry, are protected from the harmful effects of water.

FIG. 11 schematically illustrates the circuitry that supplies electrical power to the headlights 28, 30. A conventional 12-volt DC battery 24 has a positive terminal connected to power line 46 and a negative terminal connected to power line 48. A fuse 50 is located in power line 46, and a run relay 52 is located in line 46 after the fuse 50. The run relay 52 is normally open, and closes when the engine is operating. The run relay 52 is controlled by an electronic control unit 51 for the personal watercraft 10. The electronic control unit 51 closes the run relay 52 when the engine is operating. Preferably, the electronic control unit 51 uses engine crankshaft rpm sensors to detect when the engine is operating. It may be desirable to allow run relay 52 to be actuated by an operator controlled override switch 53. For instance, the override switch 53 could be used to temporarily turn on the headlights 28, 30 when the engine is not operating, or to temporarily turn off the headlights 28, 30 when the engine is operating.

When the run relay 52 is closed, electrical power from the positive terminal of the battery 24 is supplied through power line 46 to headlight lamp 28, 30. Power line 48 connects the negative side of the headlight lamp 28, 30 to the negative terminal of the battery 24.

FIG. 12 illustrates a circuit that provides stroboscopic electrical power to the headlight lamp 28, 30 when the engine is operating. The circuit in FIG. 12 is similar in many respects to the circuit in FIG. 11. In FIG. 12, the battery 24 is a 12-volt DC battery having a positive terminal connected to power line 46 and a negative terminal connected to power line 48. A fuse 50 and a run relay 52 are located in power line 46. The run relay 52 is normally open, and closes when the engine is operating. When the relay 52 is closed, power is available to a strobe control unit 54 from the positive terminal of battery 24 through power line 46. The negative side of the strobe control unit 54 is connected to the negative terminal of battery 24 via power line 48. If illuminated light is white, the strobe control unit 54 is preferably a strobe circuit having an irregular pulse frequency, such as a Wheelen strobe control unit modified to produce an irregular pulse. If illuminated light is not white, such as amber, it is preferred that a regular strobe pulse be used. The strobe control unit 54 provides stroboscopic DC electrical power through lines 56, 58 to headlight lamps 28, 30. The system shown in FIG. 12 provides stroboscopic illumination from headlight lamps 28, 30, which is more easily noticeable to other boaters. In addition, providing stroboscopic electrical power reduces the overall amount of electrical power required from the battery 24 to operate the headlight lamps 28, 30.

FIG. 4 and 5 illustrate a watercraft 110 having a daytime running headlight 128 in accordance with a second embodiment of the invention. In many respects, the watercraft 110 shown in FIGS. 4 and 5 is similar to the watercraft 10 shown in FIGS. 1 and 2, and similar reference numbers are used to designate similar parts to facilitate understanding where appropriate. In the watercraft 110 shown in FIGS. 4 and 5, the daytime running headlight 128 is mounted to the front hood 26 of the watercraft 110, instead of to the deck shell 14 of the watercraft 10 as in FIG. 1.

Locating the daytime running headlight 128 on the front hood 26 has the advantage of positioning the headlight 128 higher above the water line. This tends to make it more likely that another boater will notice the daytime running headlight 128.

As described in conjunction with FIGS. 1–3, the daytime running headlight 128 is preferably sealed by a clear or tinted transparent lens cover. Note that the front hood 26 includes side panels 130 surrounding the headlight chamber for headlight 128. It may be desirable to provide transparent side panels 130 to improve peripheral illumination. The watercraft 110 shown in FIGS. 4 and 5 can implement a continuously illuminated daytime running headlight 128 in accordance with the electrical circuitry shown in FIG. 11, or can implement stroboscopic illuminated daytime running headlights in accordance with the electrical circuitry shown in FIG. 12, or other equivalent circuitry.

Figure 7:
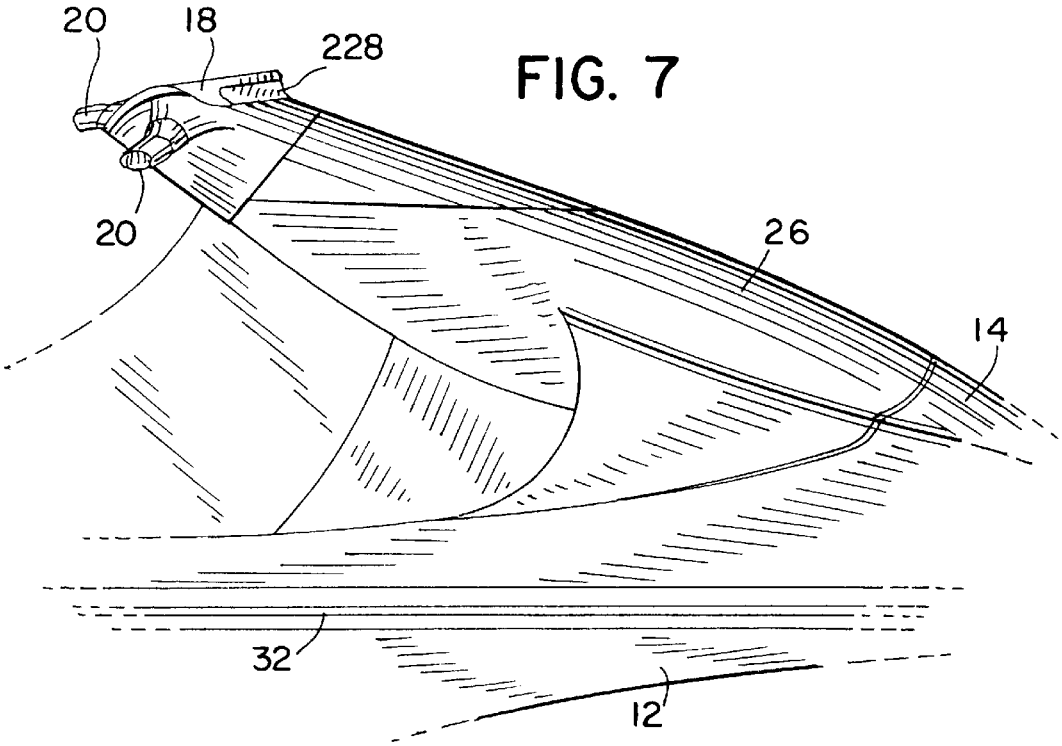
FIG. 7 is a side elevational view of a bow portion of the personal watercraft shown in FIG. 6.

FIGS. 6 and 7 illustrate a watercraft 210 having a daytime running headlight 228 mounted on the steering assembly 18 in accordance with a third embodiment of the invention. In many respects, the watercraft 210 shown in FIGS. 6 and 7 is similar to the watercraft 110 shown in FIGS. 4 and 5 and to the watercraft 10 shown in FIGS. 1 and 2, and like reference numerals are used to designate similar parts where appropriate to facilitate understanding.

In FIGS. 6 and 7, the daytime running headlight 228 mounted on the steering assembly 18 is located forward of handlebars 20. When the watercraft 210 is turned by rotating the steering assembly 18, the daytime running headlight 228 is contemporaneously turned in the direction in which the watercraft 210 is turning. This promotes the conspicuity of the watercraft 210 to other boaters in the direction in which the watercraft 210 is turning.

It is preferred that the daytime running headlight 228 be mounted within a sealed headlight compartment in the steering assembly 18 having a transparent lens cover in a similar manner to that described with respect to FIG. 3. In any event, the daytime running headlight 228 and associated wiring should be protected from the harmful effects of repeated exposure to water. Mounting the daytime running headlight 228 on the steering assembly 18 advantageously positions the daytime running headlight 228 high on the watercraft 210, thus enhancing the noticeability of the daytime running headlight 228 to other boaters.

It is relatively easy to wire the system shown in FIGS. 6 and 7, whereas the system shown in FIGS. 4 and 5 requires more sophisticated wiring for the daytime running headlight 128 mounted on the movable front hood 26. The watercraft 210 shown in FIGS. 6 and 7 can implement a continuously illuminated daytime running headlight 228 in accordance with the electrical circuitry shown in FIG. 11 or equivalent circuitry, or it can implement stroboscopic illumination of daytime running headlight 228 in accordance with the electrical circuitry shown in FIG. 12 or its equivalent.

Figure 8:
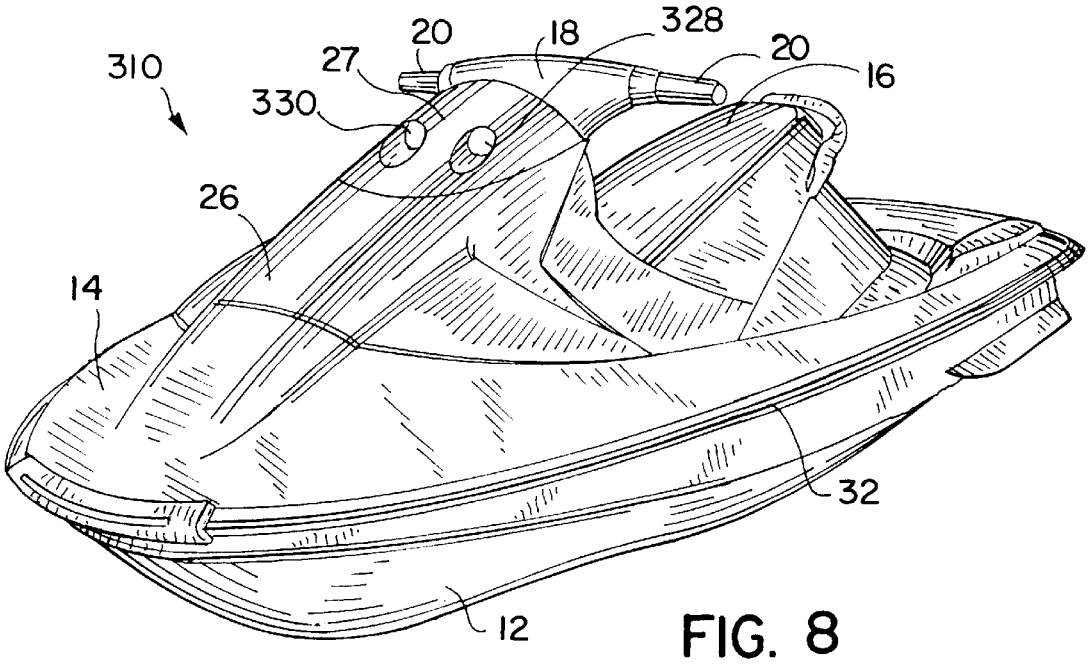
FIG. 8 is a personal watercraft having a daytime running headlight in accordance with a fourth embodiment of the invention.
Figure 9:
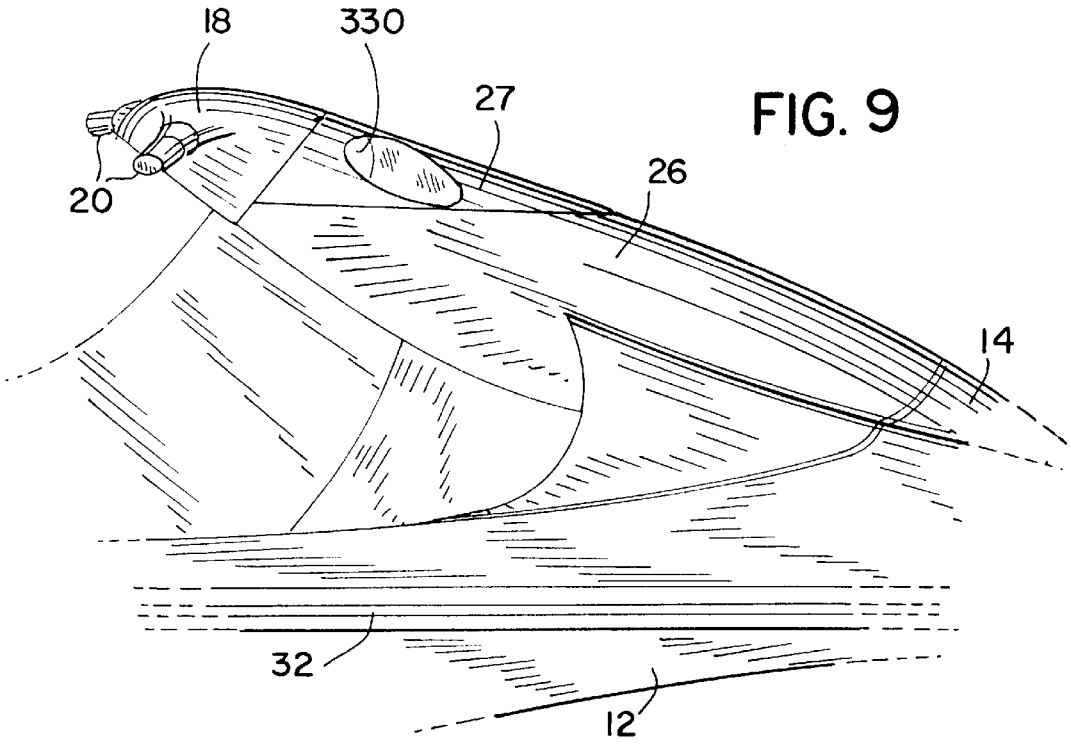
FIG. 9 is a side elevational view of the bow portion of the personal watercraft shown in FIG. 8.

FIGS. 8 and 9 illustrate a watercraft 310 in accordance with a fourth embodiment of the invention, having a port side daytime running light 328 and a starboard side daytime running light 330 mounted to the helm 27 of the watercraft 310 between the front hood 26 and the steering assembly 18. The watercraft 310 shown in FIGS. 8 and 9 is similar in many respects to the watercraft 210 shown in FIGS. 6 and 7, to the watercraft 110 shown in FIGS. 4 and 5, and to the watercraft 10 shown in FIGS. 1 and 2. Therefore, similar reference numbers are used to designate similar components where appropriate to facilitate understanding.

Mounting the daytime running headlights 328, 330 on the helm 27 as shown in FIGS. 8 and 9, has the advantage of positioning the daytime running headlights 328, 330 high on the watercraft 310, thus improving conspicuity of the headlights 328, 330 by other boaters. It also simplifies mechanical and electrical assembly because the helm 27 does not move with respect to the hull 12 and the deck 14 of the watercraft 310. To enhance the conspicuity of daytime running headlights 328, 330, it is preferred that a linkage assembly 332, FIG. 10, be used to mechanically rotate the daytime running headlights 328, 330 when the steering assembly 18 is rotated to turn the watercraft 310. In FIG. 10, the steering assembly 18 is mechanically connected to a linkage assembly drive bar 334 via belt 336. When the steering assembly 18 is rotated in accordance with arrow 338 to turn the watercraft 310, belt 336 moves in the direction of arrow 340 to rotate linkage assembly drive wheel 342 in accordance with arrow 344. The rotation of linkage assembly drive wheel 342 moves the linkage assembly drive bar 334 in the direction of arrow 346. As the linkage assembly drive bar 334 moves in the direction of arrow 346, the drive bar 334 moves headlight lever arms 348, 350 to turn headlights 330 and 328 in accordance with arrows 352. In this manner, the daytime running headlights 328 and 330 are turned in the direction that the watercraft 310 is turning, thus enhancing noticeability of the watercraft 310 to other boaters in the direction in which the watercraft 310 is turning.

The watercraft 310 shown in FIGS. 8 and 9 can implement continuously illuminated daytime running lights 328, 330 in accordance with the electrical circuitry shown in FIG. 11 (or its equivalent), or it can implement stroboscopic illumination of daytime running headlights 328, 330 in accordance with the electrical circuitry shown in FIG. 12 (or its equivalent). It is preferred that the daytime running headlights 328, 330 shown in FIGS. 8 and 9, be mounted within a sealed headlight compartment having a transparent lens cover in a similar manner to that described with respect to FIG. 3.

The above description describes exemplary embodiments of the invention, and the invention is not limited to the specific forms shown. Various alternatives, modifications and equivalents to the invention may be apparent to those skilled in the art. Such alternatives, modifications and equivalents should be considered to fall within the scope of the following claims.

As an alternative to providing a sealed transparent lens cover 34, it may be desirable to use headlight lamps having a polycarbonate lens, or some other lens that can withstand repeated use in the marine environment. Even if headlights having polycarbonate lenses are used, it is important to protect other electrical components associated with the headlights from the effects of water.

I claim:

1. A personal watercraft comprising:

a hull shell and a deck shell attached along a deck line to define an engine compartment therebetween;

an engine located within the engine compartment;

a steering assembly having a grippable steering member mounted on the deck shell;

a seat located rearward of the steering assembly;

a headlight mounted to the watercraft above the deckline and forward of the steering member;

an electrical power source located within the engine compartment that provides electrical power to the headlight whenever the engine is operating; and an electronic control unit for the personal watercraft;

a run relay that receives a control signal from the electronic control unit, wherein the control signal from the electronic control unit closes the run relay so that electrical power can be supplied from the electrical power source to the headlight when the engine is operating; and a user-operated override switch that temporarily opens the run relay when the engine is operating.

2. A personal watercraft as recited in claim 1 wherein the electrical power source includes a battery located within the engine compartment.

3. A personal watercraft as recited in claim 1 wherein the headlight has a center illumination axis and the headlight illuminates light that is visible in a forward direction of the watercraft along the illumination axis and also peripherally at least 90° rearward of a headlight illumination axis.

4. A personal watercraft as recited in claim 1 further comprising a strobe control box that receives electrical power from the electrical power source and provides stroboscopic electrical power to the headlight when the engine is operating.

5. A personal watercraft as recited in claim 1 wherein the headlight illuminates stroboscopic light when the engine is operating.

6. A personal watercraft as recited in claim 1 further comprising a sealed transparent lens cover that covers and seals the headlight mounted to the watercraft.

7. A personal watercraft as recited in claim 1 wherein the deck shell includes a front hood and the headlight is mounted to the front hood.

8. A personal watercraft as recited in claim 1 wherein the steering assembly rotates with respect to the deck shell, and the headlight is mounted to the steering assembly so that the orientation of the headlight moves when the steering assembly moves with respect to the deck shell.

9. A personal watercraft as recited in claim 1 wherein the deck shell includes a front hood, and a helm that is positioned between the front hood and the steering assembly, and the headlight is mounted to the helm.

10. A personal watercraft as recited in claim 9 wherein the headlight is mounted to a linkage assembly providing proportional movement of the headlight with respect to movement of the steering member to turn the headlight in the direction in which the watercraft is turning.

11. A personal watercraft as recited in claim 1 further comprising a second headlight mounted to the watercraft above the deckline and forward of the steering member.

12. A personal watercraft comprising:

a hull shell and a deck shell attached along a deck line to define an engine compartment therebetween;

an engine located within the engine compartment;

a steering assembly having a grippable steering member mounted on the deck shell;

a seat located rearward of the steering assembly;

a headlight mounted to the watercraft above the deckline and forward of the steering member;

an electrical power source located within the engine compartment that provides electrical power to the headlight whenever the engine is operating;

wherein the deck shell includes a headlight compartment and the headlight is mounted within the headlight compartment, and the personal watercraft further comprises a sealed transparent lens cover that covers and seals the headlight mounted within the headlight compartment.

13. A personal watercraft as recited in claim 12 further comprising a strobe control box that receives electrical power from the electrical power source and provides stroboscopic electrical power to the headlight when the engine is operating.

14. A personal watercraft as recited in claim 13 wherein the stroboscopic electrical power is provided at an irregular pulse frequency.

15. A personal watercraft as recited in claim 12 wherein the headlight illuminates stroboscopic light when the engine is operating.

16. A personal watercraft comprising:

a hull shell and a deck shell attached along a deck line to define an engine compartment therebetween;

an engine located within the engine compartment;

a steering assembly having a grippable steering member mounted on the deck shell;

a seat located rearward of the steering assembly;

a headlight mounted to the watercraft above the deckline and forward of the steering member; and an electrical power source located within the engine compartment that provides electrical power to the headlight whenever the engine is operating;

wherein the deck shell includes a front hood and the headlight is mounted to the deck shell forward of the front hood.

17. A personal watercraft as recited in claim 16 wherein the headlight illuminates stroboscopic light when the engine is operating.

* * * * *